US008322328B2

(12) United States Patent
Solberg

(10) Patent No.: US 8,322,328 B2
(45) Date of Patent: Dec. 4, 2012

(54) SOLID-TO-HYBRID TRANSITIONING ARMATURE RAILGUN WITH NON-CONFORMING-TO-PREJUDICE BORE PROFILE

(75) Inventor: Jerome Michael Solberg, Berkeley, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 79 days.

(21) Appl. No.: 13/110,851

(22) Filed: May 18, 2011

(65) Prior Publication Data

US 2012/0000450 A1 Jan. 5, 2012

Related U.S. Application Data

(60) Provisional application No. 61/345,920, filed on May 18, 2010.

(51) Int. Cl.
*F41B 6/00* (2006.01)

(52) U.S. Cl. ..... 124/3; 89/8

(58) Field of Classification Search ..... 89/8; 124/3
See application file for complete search history.

(56) References Cited

U.S. PATENT DOCUMENTS 4,467,696 A * 8/1984 McNab et al. ..... 89/8
4,485,720 A 12/1984 Kemeny
4,577,545 A 3/1986 Kemeny
5,050,478 A 9/1991 Juston et al.
5,076,135 A * 12/1991 Hurn et al. ..... 89/8
5,078,042 A 1/1992 Jensen
5,133,242 A 7/1992 Witt
5,285,763 A 2/1994 Igenbergs
5,483,863 A * 1/1996 Dreizin ..... 89/8
5,856,630 A * 1/1999 Meger ..... 89/8
7,398,722 B1 * 7/2008 Sims, Jr. ..... 89/8
8,079,352 B1 * 12/2011 Veracka et al. ..... 124/3
8,109,190 B2 * 2/2012 Proulx ..... 89/8

OTHER PUBLICATIONS

Rashleigh, et al., "Electromagnetic acceleration of macroparticles to high velocities", J. Appl. Phys. 49(4), pp. 2540-2542 (Apr. 1978).
Hawke, et al., Railgun Performance With a Two-stage Light-Gas Gun Injector, IEEE Transactions on Magnetics, vol. 27, No. 1, pp. 28-32 (Jan. 1991).
Tidman, et al., "A Gas-Insulated Railgun", IEEE Transactions on Plasma Science, vol. 21, No. 6, pp. 784-785 (Dec. 1993).
Drobyshevski, et al., "Physics of Solid Armature Launch Transition into Arc Mode", IEEE Transactions on Magnetics, vol. 37, No. 1, pp. 62-66 (Jan. 2001).
Trevor E. James, "A Transitioning Hybrid Armature Concept", IEEE Transactions on Magnetics, vol. 37, No. 1, pp. 77-80 (Jan. 2001).
Barber, et al., "A Survey of Armature Transition Mechanisms", IEEE Transactions on Magnetics, vol. 39, No. 1, pp. 47-51 (Jan. 2003).

(Continued)

*Primary Examiner* — Michael David
(74) *Attorney, Agent, or Firm* — James S. Tak

(57) ABSTRACT

An improved railgun, railgun barrel, railgun projectile, and railgun system for accelerating a solid-to-hybrid transitioning armature projectile using a barrel having a bore that does not conform to a cross-sectional profile of the projectile, to contact and guide the projectile only by the rails in a low pressure bore volume so as to minimize damage, failure, and/or under-performance caused by plasma armatures, insulator ablation, and/or restrikes.

14 Claims, 7 Drawing Sheets

OTHER PUBLICATIONS

A. P. Glinov, "The Stability and the Conditions for Initiation of Electro-Arc Discharges in Railguns", High Temperature, vol. 45, No. 2, pp. 143-153 (2007).

Wetz, et al., "Advancements in the Development of a Plasma-Driven Electromagnetic Launcher", IEEE Transactions on Magnetics, vol. 45, No. 1, pp. 495-500 (Jan. 2009).

* cited by examiner

SIDE VIEW

TOP VIEW

REAR END VIEW

SOLID-TO-HYBRID TRANSITIONING ARMATURE RAILGUN WITH NON-CONFORMING-TO-PREJUDICE BORE PROFILE

CROSS-REFERENCES TO RELATED APPLICATIONS

This application claims the benefit of U.S. Provisional Application No. 61/345,920, filed May 18, 2010 and incorporated by reference herein.

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to railguns. More particularly, the invention relates to an improved railgun, railgun barrel, railgun projectile, and railgun system for accelerating a solid-to-hybrid transitioning armature projectile using a barrel having a barrel bore that does not conform to a cross-sectional profile of the projectile, to contact and guide the projectile only by the rails in a low pressure bore volume so as to minimize damage, failure, and/or underperformance caused by plasma armatures, insulator ablation, and/or restrikes.

BACKGROUND OF THE INVENTION

Railguns are electrical guns known to accelerate projectiles along a pair of electrically conductive rails by permitting a large electric current to pass between the pair of rails by way of a conductive medium of, produced by, or otherwise associated with the projectile. This current interacts with the strong magnetic fields generated by the rails to accelerate the projectile using the same principles as the homopolar motor, and have been known to achieve velocities greater than what is typically achievable by conventional firearms-based technology. For example, railguns have been used in experiments to accelerate gram-sized and larger objects to speeds of 6 km/sec.

Various approaches are known for accelerating projectiles using railguns. One approach relies on a column of electrically conductive gas to produce a plasma armature to provide the propulsive force, in the form of gas pressure, to a non-conductive sabot typically made of a high-strength plastic, such as for example Lexan. It is appreciated that a plasma armature involves rail-to-rail plasma arcing. Other operating modes involve (1) using a solid conductor in contact with the rails for producing a solid armature, (2) using a transitioning hybrid armature which operates with both plasma arcing as well as conduction through a solid (plasma-solid-plasma conduction), and (3) tandem operation, which can involve both plasma armature and hybrid armature operation. It is notable, however, that plasma armatures have deleterious effects on railgun operation and projectile velocities, due to for example ablation drag, restrike, etc. Therefore plasma One example railgun is shown in the article "The Gas-Insulated-Railgun" by Tidman, Parker, et. al., which uses a high-pressure gas fill in a steel tube. In this configuration a trailing wake can be produced, and at the wake boundary there is likely to be a region exactly at the "Paschen minimum", i.e. where the value of pressure for the rail-to-rail gap at which the breakdown voltage is a minimum. This situation is likely to produce restrike arcs in the wake.

Another example is shown in the article "Railgun Performance with a Two-Stage Light-Gas Gun Injector" by Hawke, Suseoff, et. al., which involves a projectile-conforming sealed barrel design, along with a solid/hybrid transitioning armature. Because of the conforming barrel bore (i.e. barrel walls substantially conform to the cross-sectional profile of the projectile), it is typical in such designs that a plasma armature forms behind the hybrid armature (i.e. referred to as "tandem" operation). This is likely because the plasma cannot be completely contained within the hybrid and leaks rearward. The conforming barrel bore provides a means to support a non-zero plasma pressure and hence a non-zero plasma conductivity; the hot plasma in the rear of the armature providing a conductive path which inevitably leads to a plasma armature in the rear. In fact the experimental results show that tandem operation commences almost immediately. However, once a plasma armature forms in the back, all the deleterious effects of a plasma armature arise, i.e. ablation drag, restrike, etc.

And another example is described in the article "A Transitioning Hybrid Armature Concept" by Trevor James, which involves hybrid armature in a projectile conforming barrel bore, where the "plasma brushes" live in the "legs" of an otherwise "C-shaped" solid armature. The concept attempts to control the plasma armature pressure using radially-inward-directed "exhaust ducts". This design is likely to operate in the "tandem" mode (hybrid armature plus plasma armature) at ultra-high-velocities, since the hot, conductive exhaust gases are directed rearward in a closed barrel, leading to tandem operation in a similar manner as in the Hawke, Suseoff article. For Ultra-High-Velocity operation tandem operation is not desirable for same reasons as discussed for the Hawke, Suseoff design.

As such, there is a need for a railgun designed to operate without and prevent the formation of plasma armatures, to enable high and ultra-high velocities in railgun applications.

SUMMARY OF THE INVENTION

One aspect of the present invention includes a railgun comprising: a barrel having a pair of parallel conductive rails each with a convex rail surface facing the other convex rail surface with only said convex rail surfaces of the rails adapted to contact ("rail-only contact") a projectile launched through the barrel; a barrel bore defined between and in part by said convex rail surfaces and having a cross-sectional profile ("non-conforming-to-projectile bore profile") that does not completely conform to a cross-sectional profile of the projectile; and an enclosure surrounding the barrel bore and filled with a low-pressure gas, whereby the rail-only contact, the non-conforming-to-projectile bore profile, and the low-pressure gas in the enclosure contribute to minimizing plasma armature formation and restrikes.

Another aspect of the present invention includes a railgun projectile comprising, a nonconductive sabot; and a conductive section connected to the sabot and having a rear conductive section with a pair of contact surfaces each for contacting a corresponding one of the convex rail surfaces and a forward conductive section spanning less than a gap distance between the convex rail surfaces, wherein the rear section and the forward section are adapted so that when the projectile is accelerated along an energized pair of parallel conducting rails, in a first stage of acceleration an electrical current is produced across the rear conductive section as a solid armature to accelerate the projectile until the rear conductive section is ablated prior to reaching the muzzle end of the barrel, and in a second stage of acceleration an electrical current is produced across the forward section as a hybrid armature to accelerate the projectile out through the muzzle end of the barrel.

Another aspect of the present invention includes a railgun system comprising: a barrel having a breech end, a muzzle end, a pair of parallel conductive rails extending between the breech and muzzle ends, with each conductive rail having a convex rail surface facing the other convex rail surface with only said convex rail surfaces of the rails adapted to contact ("rail-only contact") a projectile launched through the barrel; a barrel bore defined between and in part by said convex rail surfaces and having a cross-sectional profile ("non-conforming-to-projectile bore profile") that does not completely conform to a cross-sectional profile of the projectile; and an enclosure surrounding the barrel bore and filled with a low-pressure gas, whereby the rail-only contact, the non-conforming-to-projectile bore profile, and the low-pressure gas in the enclosure contribute to minimizing plasma armature formation and restrikes; and a projectile having a nonconductive sabot, and a conductive section connected to the sabot and having a rear conductive section with a pair of contact surfaces each for contacting a corresponding one of the convex rail surfaces, and a forward conductive section spanning less than a gap distance between the convex rail surfaces, wherein the rear section and the forward section are adapted so that upon connecting the conductive rails to a voltage source, in a first stage of acceleration an electrical current is produced across the rear conductive section as a solid armature to accelerate the projectile until the rear conductive section is ablated prior to reaching the muzzle end of the barrel, and in a second stage of acceleration an electrical current is produced across the forward section as a hybrid armature to accelerate the projectile out through the muzzle end of the barrel.

BRIEF DESCRIPTION OF THE DRAWINGS

The accompanying drawings, which are incorporated into and form a part of the disclosure, are as follows.

DETAILED DESCRIPTION

Generally, the present invention is a railgun designed to launch a projectile to high velocities and ultra-high velocities (e.g. greater than 6 km/sec, such as 10-15 km/sec) using an "open barrel" architecture (e.g. rail-only contact with projectile and a non-conforming-to-projectile bore profile), a solid-to-hybrid transitioning armature, and low pressure gas fill to increase rail-to-rail breakdown voltage, which together contribute to minimize and avoid the deleterious effects associated with plasma armature formation and tandem operation, which may include restrikes.

Figure 1A:
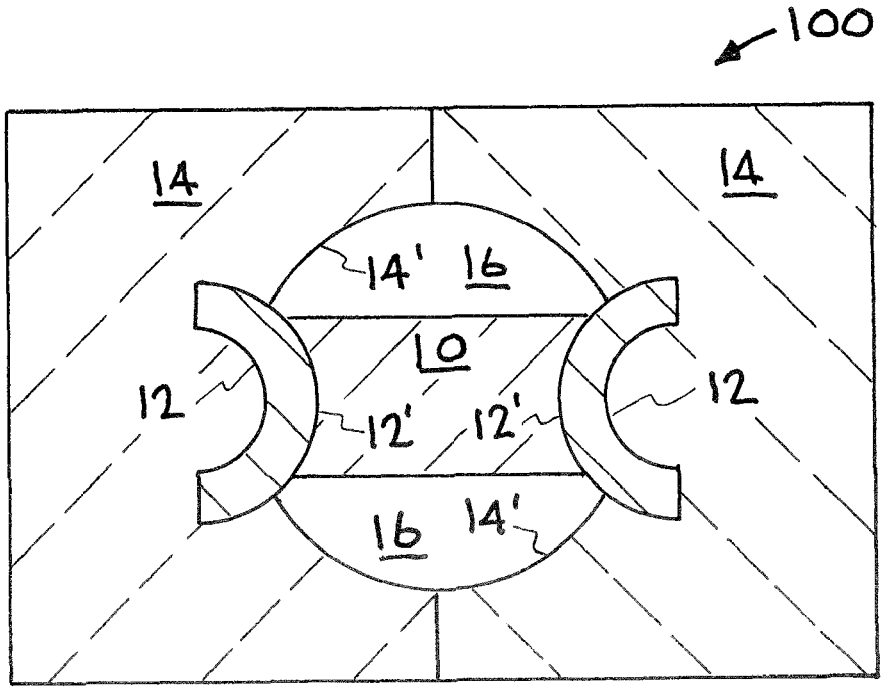
FIG. 1A is a cross-sectional view of a first exemplary embodiment of the open barrel (i.e. having non-conforming-to-projectile barrel bore) of the present invention.

Turning now to the drawings, FIG. 1A shows a first exemplary embodiment of the open barrel structure of the present invention. In particular, FIG. 1A shows a barrel 100 having a pair of parallel conductive rails 12 defining in part a barrel bore 16 therebetween (which is shown occupied in part by projectile 10). The rails 12 are shown having convective rail surfaces 12' facing each other across the barrel bore 16. Furthermore, only the convex rail surfaces of the rails are adapted to contact the projectile 10 that is launched through the barrel, and is characterized as "rail-only contact". FIG. 1A also shows a projectile 10 positioned in the barrel bore 16 between the rails 12. which mate with concave surface of the projectile. The open space above and below the projectile is an important feature for mitigating plasma armature formation and secondard strikes (restrikes). As shown in FIG. 1A, it is notable that only the convex rail surfaces come in contact with the projectile. No other parts of the barrel, including the dielectric wall surfaces come in contact with the projectile.

In this embodiment, dielectric walls 14 are also shown provided and forming an enclosure, which also define in part the barrel bore, together with the convex rail surfaces. The pair of dielectric sidewalls 14 each have a dielectric sidewall surface 14' facing the other dielectric sidewall surface 14', and which are positioned away from the projectile 10 so that the barrel bore 16 is characterized as not completely conforming to the cross-sectional profile of the projectile ("non-conforming-to-projectile bore profile"). In fact, it can be seen that the area covered by the cross-sectional bore profile is larger than the cross-sectional profile of the projectile 10. While it is appreciated that some conforming to the projectile profile inherently exists dues to the mating surfaces between the projectile and the convex rail surfaces, it is not completely conforming since no other barrel surface is positioned adjacent the projectile.

Generally, the open barrel configuration of the present invention has a "non-conforming-to-projectile" barrel bore, which, as used herein in the claims, is a type surrounded and defined by a barrel wall or walls which do not substantially conform to the diametric or cross-sectional profile of the projectile, and thus subjects the projectile to contact on only a limited number (less than all) of its sides by the barrel wall(s) for guiding the projectile as it travels through the barrel. In the present invention, the barrel wall sections which do come in contact with the projectile are a pair of conductive rails (rail-only contact) which also supply the electromotive force which launches the projectile through the barrel. All other projectile surfaces not in contact with or adjacent the conductive rails are adjacent an open space, which may be the exterior environment in the case of a rail-only, partially wall-less design, or the hollow space inside an enclosed barrel chamber. In contrast, a projectile conforming barrel bore is a bore which substantially conforms to the diametric or cross-sectional profile of the projectile. In particular, the barrel wall or walls of the barrel substantially conform to the diametric or cross-sectional profile of the projectile, as exemplified by the gun barrels of most conventional firearms, and thus subjects the projectile to contact on all sides (with the exception of the front and rear) by the barrel walls for guiding the projectile as it travels through the barrel.

Figure 6:
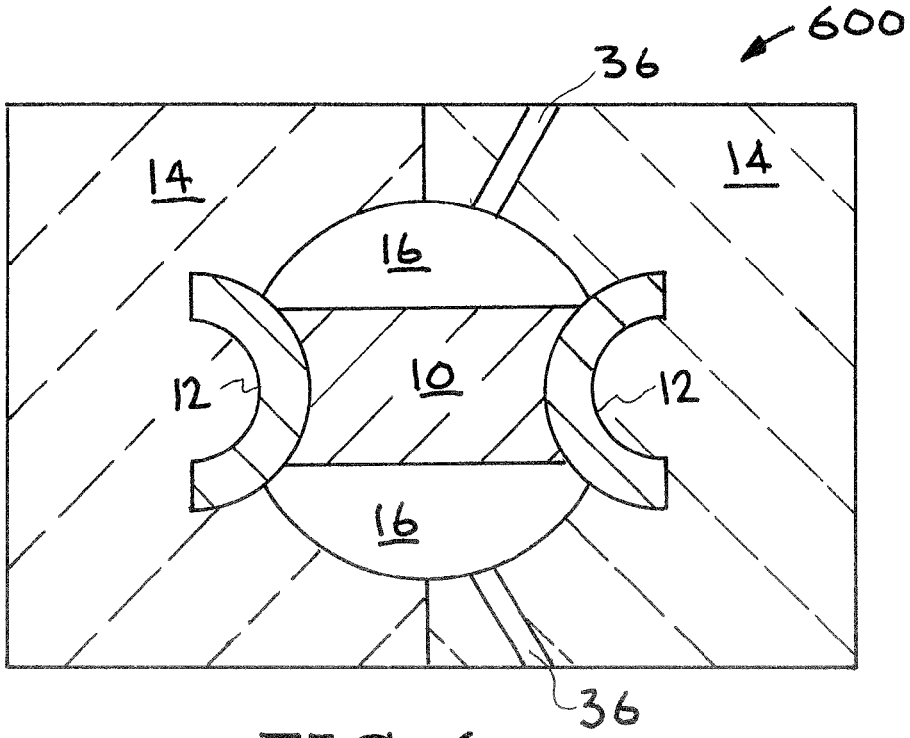
FIG. 6 is a cross-sectional view of another exemplary embodiment of the open barrel shown with ports for introducing a low pressure gas.

The present invention also relies on a low-pressure (e.g. all the way down to a perfect vacuum) gas fill, with the ambient pressure below the Paschen minimum, and hence restrike in the wake is averted. In particular, the enclosure 14 in FIG. 1A surrounding the barrel bore is filled with a low-pressure gas. The reason for a "low pressure" gas fill is that certain gases such as SF6 have a greater minimum breakdown voltage than air, and hence a prefill of this gas (followed by a pumping down to a low pressure) is desirable for increased performance. "Low-pressure" may include, for example, 2 atm or less pressure. In particular, the low-pressure gas is of a type capable of increasing rail-to-rail breakdown voltage in the presence of high temperature metal vapor. The gas is preferably supplied via ports 36 shown in FIG. 6 showing embodiment 600. The open barrel architecture and low-pressure gas help eliminate plasma armature or tandem operation, since without sidewalls closely positioned adjacent the projectile the gas in the tail cannot maintain a non-zero pressure, and hence cannot sustain a conductive path.

Figure 1B:
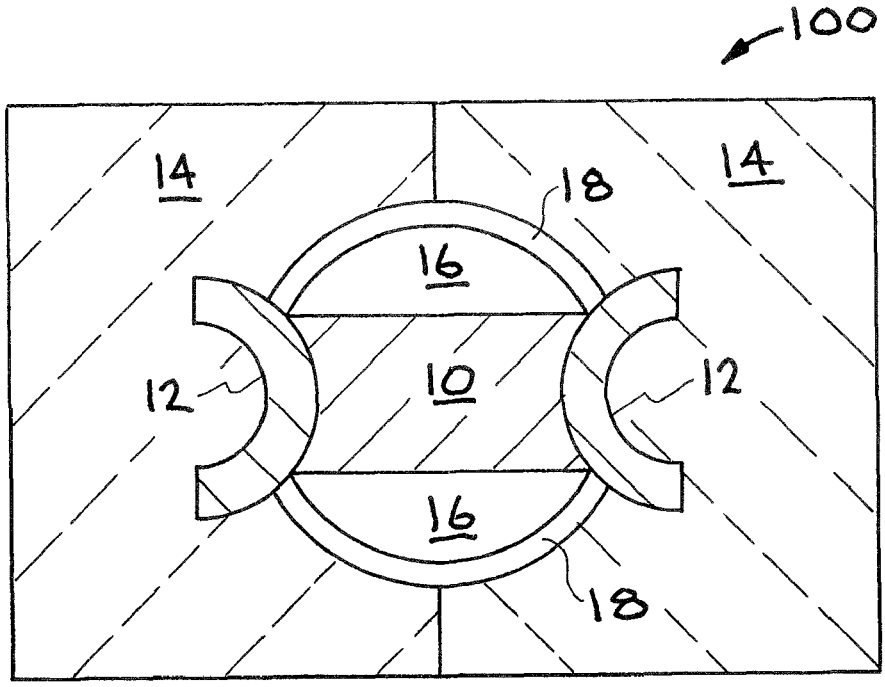
FIG. 1B is a cross-sectional view of a first exemplary embodiment of the open barrel (i.e. having non-conforming-to-projectile barrel bore) of the present invention also shown with a layer of energy-absorbing substance on the dielectric surfaces.

And FIG. 1B shows a second exemplary embodiment of the open-barrel structure of the present invention. In particular, FIG. 1B shows the dielectric surfaces coated with an energy-absorbing material 18, as known in the art, capable of vaporizing to a low-temperature dielectric gas, which also prevents and minimizes restrikes.

Figure 2A:
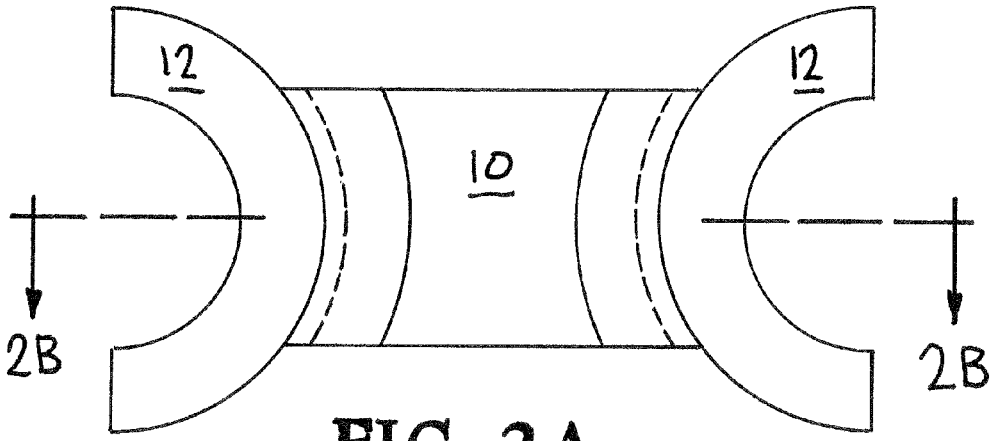
FIG. 2A is a cross-sectional view of the exemplary embodiment of FIG. 2B.
Figure 2B:
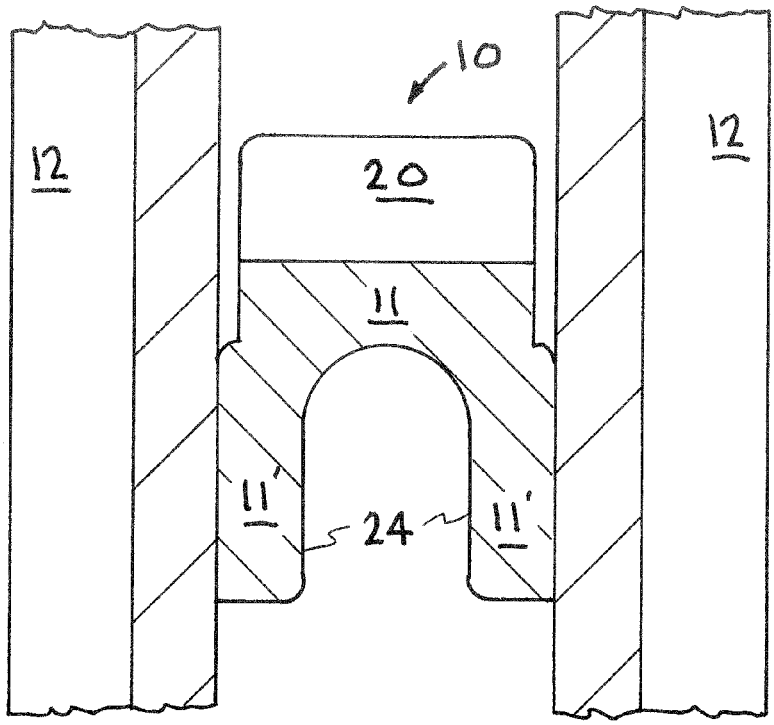
FIG. 2B is a top view of a section of the barrel of the present invention, including an exemplary embodiment of the projectile of the present invention.
Figure 3A:
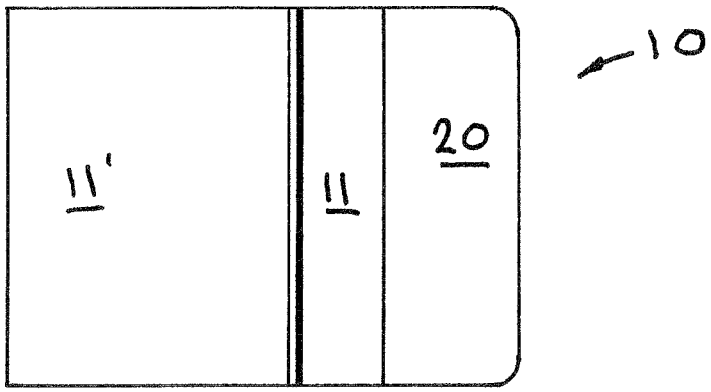
FIG. 3A-C show side, top and back end views, respectively of the conductive section of the projectile.
Figure 3B:
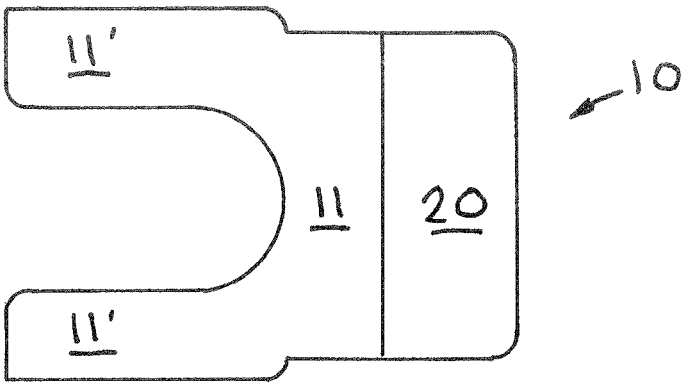
Figure 3C:
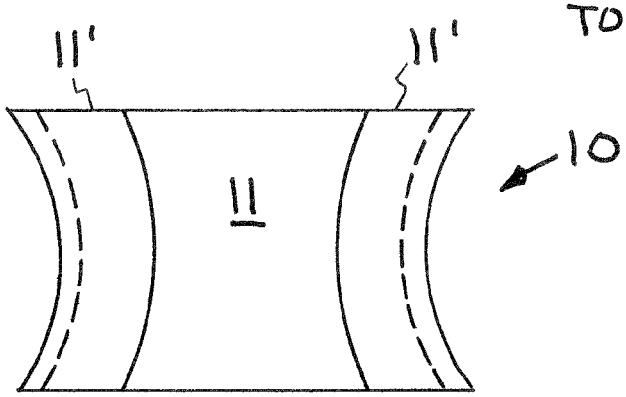

FIGS. 2A-2B show an exemplary projectile 10 positioned in the barrel bore of the present invention. In particular, the projectile 10 has a nonconductive sabot 20 (may include payload) at a leading end, and a conductive section connected to the sabot. The conductive section includes a rear conductive section 11' shown as a pair of C-shaped "wings" 24 with a pair of contact surfaces, each contact surface for contacting a corresponding one of the convex rail surfaces of the conductive rails 12, and a forward conductive section 11 spanning less than a gap distance between the convex rail surfaces. Additional views of the projectile and its two sections are shown in FIGS. 3A-C.

Figure 4A:
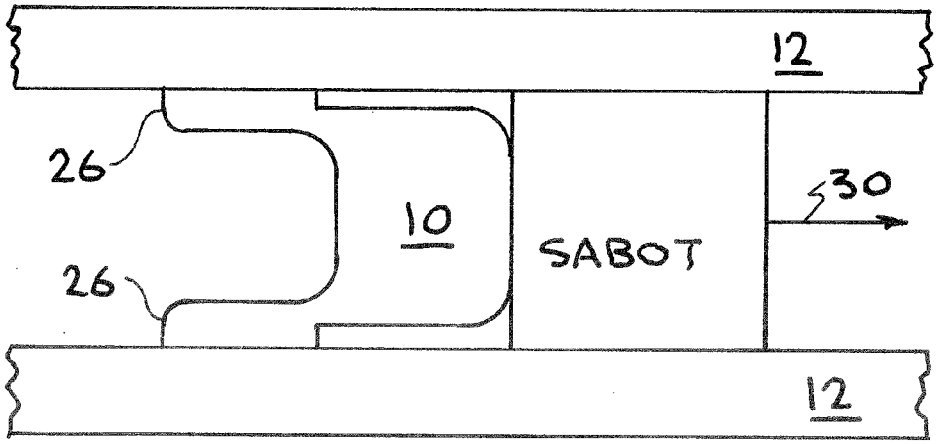
FIGS. 4A-B show time lapsed views of an exemplary projectile embodiment as it is launched in the barrel of the present invention.
Figure 4B:
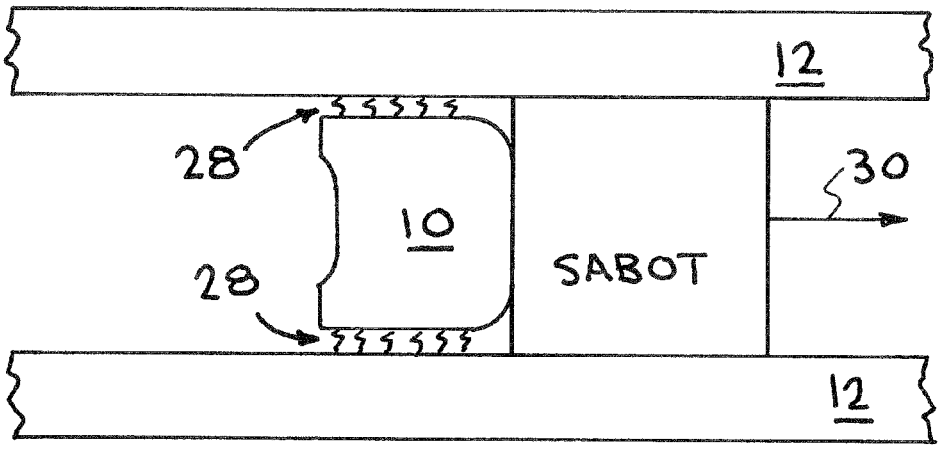

And FIGS. 4A and 4B show the transition from solid armatures (FIG. 4A) to a hybrid armature (FIG. 4B) of the conductive section of the projectile as it is launched in the direction 30. A sabot is shown ahead of the conductive section, and plasma arcing is shown at 28 in FIG. 4B. In particular, the rear section and the forward section are adapted so that upon connecting the conductive rails to a voltage source, in a first stage of acceleration (shown in FIG. 4A), an electrical current is produced across the rear conductive section as a solid armature to accelerate the projectile. In particular, the rear conductive section is configured to be ablated prior to reaching the muzzle end of the barrel. And in a second stage of acceleration an electrical current is produced across the forward section as a hybrid armature to accelerate the projectile out through the muzzle end of the barrel. The rear section is preferably made of a material with a melting point less than a predetermined operating temperature of the railgun so as to melt away and reduce parasitic mass as the armature accelerates along the rails.

Figure 5A:
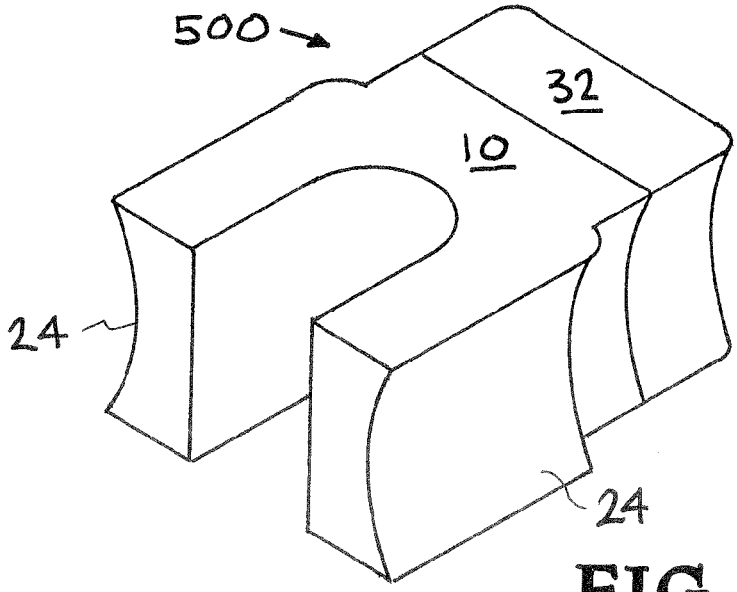
FIG. 5A shows another embodiment of the projectile having a front payload.
Figure 5B:
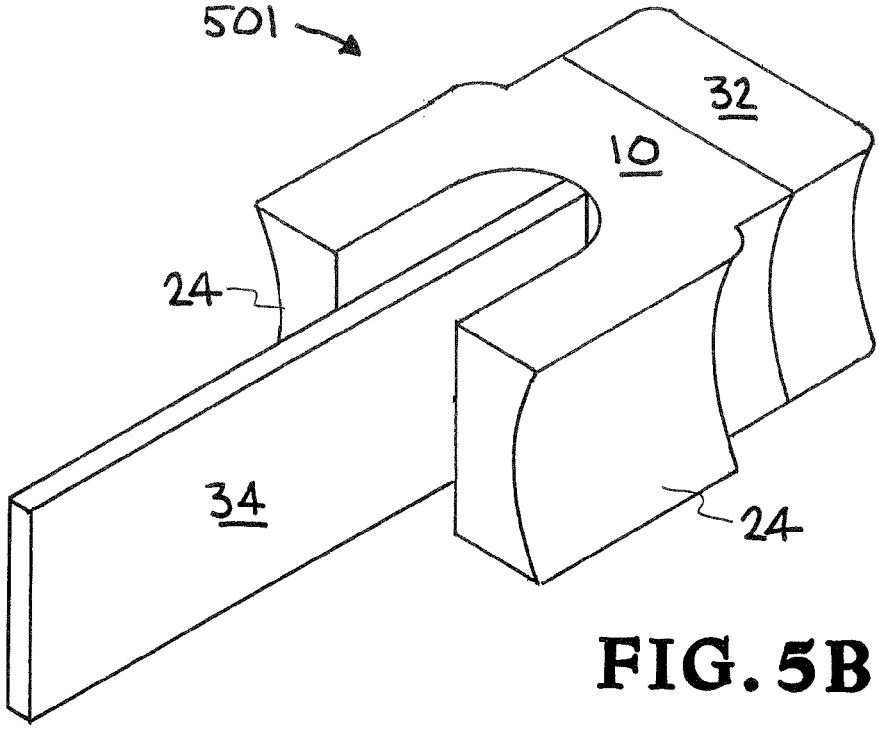
FIG. 5B shows another embodiment of the projectile having a rear payload.

And FIGS. 5A and 5B show two exemplary embodiments 500 and 501 of the projectiles showing a sabot 32 with payloads in front and to the rear of the conductive section. In particular, FIG. 5B shows a tail or shroud 34 which extends to the rear of the conductive section.

Figure 7:
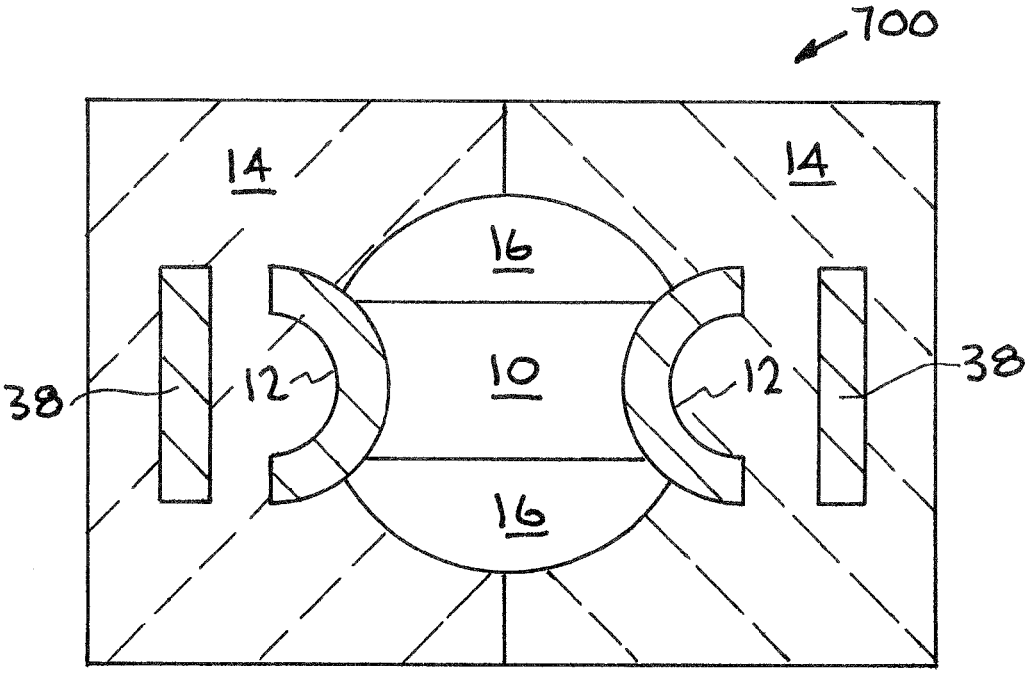
FIG. 7 is a cross-sectional view of another exemplary embodiment of the open barrel including augementing rails.
Figure 8:
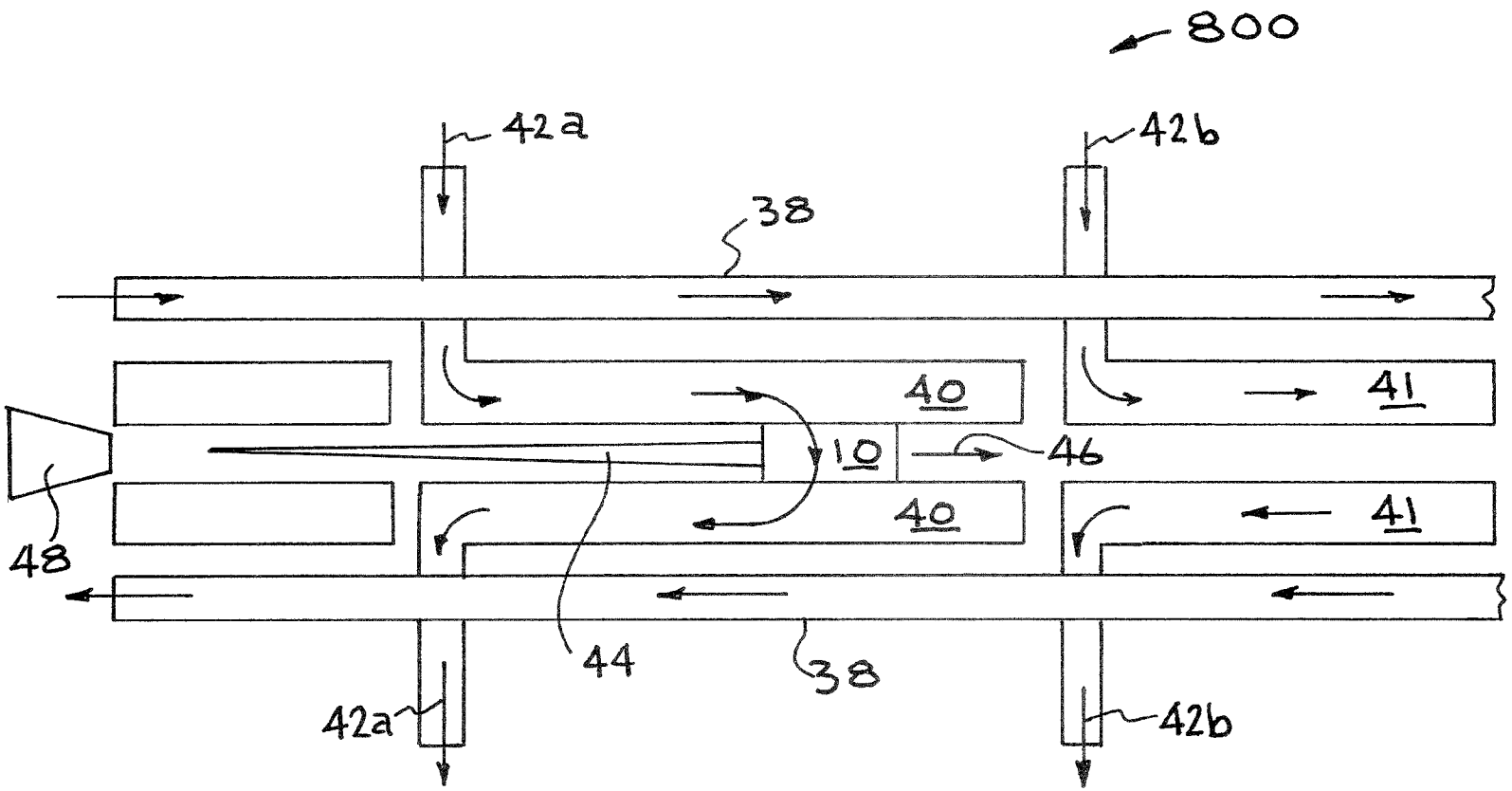
FIG. 8 is a schematic view of another embodiment of the present invention shown a barrel configuration with segmented primary rails, an injector, and augmenting rails.

FIG. 7 show another embodiment 700 showing the use of augmenting rails 38 which augment the primary rails by decreasing the required armature current for a given acceleration, and/or increase the stagnation velocity of free-running precursor or secondary arcs. At least one additional pair of parallel conductive rails ("augmenting rails") may be positioned adjacent the first pair of parallel conductive rails. FIG. 8 also shows the use of augmenting railsprimary rails in embodiment 800. FIG. 8 also shows the segmentation of the primary rails into multiple sections 40 and 41, where a current 42*a* is provided for segment 40 while a different current 42*b* is provided for segment 41. The pair of conductive rails are segmented along the length of the barrel with each rail segment powered independently from other segments. Projectile pre-acceleration is also shown in FIG. 8 using an injector 48 for injecting the projectile at the breech end of the barrel.

While particular embodiments and parameters have been described and/or illustrated, such are not intended to be limiting. Modifications and changes may become apparent to those skilled in the art, and it is intended that the invention be limited only by the scope of the appended claims.

I claim:

1. A railgun comprising:

a barrel having a pair of parallel conductive rails each with a convex rail surface facing the other convex rail surface with only said convex rail surfaces of the rails adapted to contact ("rail-only contact") a projectile launched through the barrel; a barrel bore defined between and in part by said convex rail surfaces and having a cross-sectional profile ("non-conforming-to-projectile bore profile") that does not completely conform to a cross-sectional profile of the projectile; and an enclosure surrounding the barrel bore and filled with a low-pressure gas, whereby the rail-only contact, the non-conforming-to-projectile bore profile, and the low-pressure gas in the enclosure contribute to minimizing plasma armature formation and restrikes.

2. The railgun of claim 1, wherein the barrel further includes a pair of dielectric sidewalls each having a dielectric sidewall surface facing the other dielectric sidewall surface, with the dielectric sidewall surfaces defining in part the barrel bore and positioned so as not to contact the projectile.

3. The railgun of claim 2, wherein the dielectric sidewall surfaces have an energy absorbing material thereon capable of vaporizing to a low-temperature dielectric gas.

4. The railgun of claim 1, wherein the pair of conductive rails are segmented along the length of the barrel with each rail segment powered independently from other segments.

5. The railgun of claim 1, further comprising at least one additional pair of parallel conductive rails ("augmenting rails") positioned adjacent the first pair of parallel conductive rails.

6. The railgun of claim 1, further comprising an injector connected to pre-accelerate the projectile into a breech end of the barrel.

7. A railgun projectile comprising, a nonconductive sabot; and a conductive section connected to the sabot and having a rear conductive section with a pair of contact surfaces each for contacting a corresponding one of the convex rail surfaces and a forward conductive section spanning less than a gap distance between the convex rail surfaces, wherein the rear section and the forward section are adapted so that when the projectile is accelerated along an energized pair of parallel conducting rails, in a first stage of acceleration an electrical current is produced across the rear conductive section as a solid armature to accelerate the projectile until the rear conductive section is ablated prior to reaching the muzzle end of the barrel, and in a second stage of acceleration an electrical current is produced across the forward section as a hybrid armature to accelerate the projectile out through the muzzle end of the barrel.

8. The railgun projectile of claim 7, further comprising a non-conductive tail section trailing behind the rear conductive section for precluding secondary arcs.

9. A railgun system comprising:

a barrel having a breech end, a muzzle end, a pair of parallel conductive rails extending between the breech and muzzle ends, with each conductive rail having a convex rail surface facing the other convex rail surface with only said convex rail surfaces of the rails adapted to contact ("rail-only contact") a projectile launched through the barrel; a barrel bore defined between and in part by said convex rail surfaces and having a cross-sectional profile ("non-conforming-to-projectile bore profile") that does not completely conform to a cross-sectional profile of the projectile; and an enclosure surrounding the barrel bore and filled with a low-pressure gas, whereby the rail-only contact, the non-conforming-to-projectile bore profile, and the low-pressure gas in the enclosure contribute to minimizing plasma armature formation and restrikes; and a projectile having a nonconductive sabot, and a conductive section connected to the sabot and having a rear conductive section with a pair of contact surfaces each for contacting a corresponding one of the convex rail surfaces, and a forward conductive section spanning less than a gap distance between the convex rail surfaces, wherein the rear section and the forward section are adapted so that upon connecting the conductive rails to a voltage source, in a first stage of acceleration an electrical current is produced across the rear conductive section as a solid armature to accelerate the projectile until the rear conductive section is ablated prior to reaching the muzzle end of the barrel, and in a second stage of acceleration an electrical current is produced across the forward section as a hybrid armature to accelerate the projectile out through the muzzle end of the barrel.

10. The railgun system of claim 9, wherein the barrel further includes a pair of dielectric sidewalls each having a dielectric sidewall surface facing the other dielectric sidewall surface, with the dielectric sidewall surfaces defining in part the barrel bore and positioned so as not to contact the projectile.

11. The railgun of claim 10, wherein the dielectric sidewall surfaces have an energy absorbing material thereon capable of vaporizing to a low-temperature dielectric gas.

12. The railgun system of claim 9, wherein the pair of conductive rails are segmented along the length of the barrel with each rail segment powered independently from other segments.

13. The railgun system of claim 9, further comprising at least one additional pair of parallel conductive rails ("augmenting rails") positioned adjacent the first pair of parallel conductive rails.

14. The railgun system of claim 9, further comprising an injector connected to pre-accelerate the projectile into a breech end of the barrel.

* * * * *

UNITED STATES PATENT AND TRADEMARK OFFICE

CERTIFICATE OF CORRECTION

PATENT NO. : 8,322,328 B2
APPLICATION NO. : 13/110851
DATED : December 4, 2012
INVENTOR(S) : Jerome Michael Solberg It is certified that error appears in the above-identified patent and that said Letters Patent is hereby corrected as shown below:

On the Title Page, item (54) and in the specifications, column 1, the title should read: --SOLID-TO-HYBRID ARMATURE RAILGUN WITH NON-CONFORMING-TO-PROJECTILE BORE PROFILE--.

Signed and Sealed this
Twenty-eighth Day of May, 2013

Teresa Stanek Rea
*Acting Director of the United States Patent and Trademark Office*